United States Patent [19]

Hargraves et al.

[11] Patent Number: 4,966,780

[45] Date of Patent: Oct. 30, 1990

[54] PACKAGING OF FRESH ROASTED COFFEE EXHIBITING IMPROVED AROMA RETENTION

[75] Inventors: Peter J. Hargraves, Guilford, Conn.; Robert S. Dirksing; Theodore P. Merz, both of Cincinnati, Ohio

[73] Assignee: The Procter & Gamble Company, Cincinnati, Ohio

[21] Appl. No.: 358,927

[22] Filed: May 26, 1989

Related U.S. Application Data

[63] Continuation-in-part of Ser. No. 216,554, Jul. 7, 1988.

[51] Int. Cl.[5] ..... A23F 5/00

[52] U.S. Cl. ..... 426/118; 215/1 C; 220/372; 220/374; 426/106; 426/115; 426/395; 426/397

[58] Field of Search ..... 426/397, 115, 118, 106, 426/395, 112; 220/371, 372, 374, 367; 215/1 C, 308

[56] References Cited

U.S. PATENT DOCUMENTS

| | | | |
|---|---|---|---|
| D. 262,264 | 12/1981 | Hadtke et al. | D9/370 |
| D. 262,265 | 12/1981 | Hadtke | D9/370 |
| 450,838 | 4/1891 | Perry . | |
| 836,174 | 11/1906 | Bauer . | |
| 920,791 | 5/1909 | Tonini . | |
| 1,077,383 | 11/1913 | Anglund . | |
| 1,419,580 | 6/1922 | Molinari . | |
| 1,664,564 | 4/1928 | Lipner . | |
| 1,986,741 | 1/1935 | Moser | 221/147 |
| 1,992,556 | 11/1931 | Tone | 426/397 |
| 2,076,457 | 4/1937 | Genone | 221/147 |
| 2,091,212 | 8/1937 | McNeil | 215/1 |
| 2,225,810 | 12/1940 | Waters | 99/152 |
| 2,430,663 | 11/1947 | Behrman | 99/152 |
| 2,447,581 | 8/1948 | Keith | 215/43 |

(List continued on next page.)

FOREIGN PATENT DOCUMENTS

| | | |
|---|---|---|
| 2327282 | 1/1975 | Fed. Rep. of Germany . |
| 2707406 | 8/1978 | Fed. Rep. of Germany . |

OTHER PUBLICATIONS

Packaging and Marketing of Roasted Coffee by Prof. Dr. h.c.R. Heiss et al., in ASIC, 8e Colloque, Abidjan, 1977, pp. 163–174, Nov. 28–Dec. 3.

(List continued on next page.)

*Primary Examiner*—Donald E. Czaja
*Assistant Examiner*—Drew S. Workman
*Attorney, Agent, or Firm*—E. Kelly Linman; John V. Gorman; Richard C. Witte

[57] ABSTRACT

Packaging for coffee which is to be packed as quickly as is feasible after roasting, i.e., without undergoing substantial off gassing. The packaging preferably comprises a semi-rigid, substantially gas-impervious container capable of withstanding the pressures generated by the release of carbon dioxide and other gases from the fresh roasted coffee in the container. The semi-rigid container is preferably comprised of plastic and predetermined portions of the container are preferably capable of undergoing limited deformation. This prevents instability of the base of the container, thereby keeping its vertical axis erect, and ensures that the container does not become jammed within the shipping case in which it is transported due to lateral expansion. The semi-rigid container includes resealable closure means which are capable of: initially forming and maintaining a substantially gas tight seal between the package and the atmosphere until the package is initially opened by the end user and establishing a reseal which is effective to substantially resist ambient atmospheric pressure changes upon snug reapplication of the closure means to the container. Means are preferably provided to prevent aspiration of the pressurized coffee, particularly when it is in granular form, from the discharge orifice of the container upon initial opening by the consumer. Roasted coffee product placed in packaging of the present invention prior to subsantial off gassing exhibits greatly improved aroma retention and reduced oxidation over the normal useful life of the package from initial opening by the consumer to emptying.

35 Claims, 7 Drawing Sheets

U.S. PATENT DOCUMENTS

| | | | |
|---|---|---|---|
| 2,485,303 | 10/1949 | Marcus | 259/122 |
| 2,487,274 | 11/1949 | Schaffer | 215/46 |
| 2,543,427 | 2/1951 | Warne | 222/115 |
| 2,921,707 | 1/1960 | Sloan | 215/37 |
| 2,990,079 | 6/1961 | Garvey | 215/56 |
| 3,077,409 | 2/1963 | Baselt | 99/152 |
| 3,159,298 | 12/1964 | Saw | 215/43 |
| 3,293,773 | 12/1966 | Frazer et al. | 34/92 |
| 3,403,804 | 10/1968 | Colombo | 215/31 |
| 3,559,833 | 2/1971 | Alonso | 215/31 |
| 3,581,927 | 6/1971 | Langdon | 215/43 |
| 3,672,114 | 6/1972 | Sacks | 53/88 |
| 3,871,541 | 3/1975 | Adomaitis | 215/1 C |
| 4,007,848 | 2/1976 | Snyder | 215/31 |
| 4,007,851 | 2/1977 | Walker | 215/307 |
| 4,034,116 | 7/1977 | Hamell et al. | 426/131 |
| 4,150,761 | 4/1979 | Collins | 215/228 |
| 4,230,230 | 10/1980 | Mumford | 215/321 |
| 4,269,319 | 5/1981 | Rubens | 215/228 |
| 4,273,247 | 6/1981 | Earls | 215/228 |
| 4,279,350 | 7/1981 | King | 215/228 |
| 4,349,056 | 9/1982 | Heino | 141/381 |
| 4,366,179 | 12/1982 | Nawata et al. | 426/395 |
| 4,416,381 | 11/1983 | Swartwout | 215/228 |
| 4,427,126 | 1/1984 | Ostrowsky | 215/307 |
| 4,466,548 | 8/1984 | Herbert | 215/307 |
| 4,509,653 | 4/1985 | Corbett | 215/321 |
| 4,526,797 | 7/1985 | Stone, Jr. | 426/520 |
| 4,552,767 | 11/1985 | Saleeb et al. | 426/395 |
| 4,566,508 | 1/1986 | Bowyer | 141/381 |
| 4,610,366 | 9/1986 | Estes et al. | 215/1 C |
| 4,620,639 | 11/1986 | Yoshino | 215/1 C |
| 4,738,370 | 4/1988 | Urmston et al. | 215/307 |
| 4,747,502 | 5/1988 | Luenser | 215/307 |

OTHER PUBLICATIONS

Changes of the Aroma of Roast Coffee in $O_2$-Permeable Bag Packs by O. G. Vitzthum & P. Werkhoff in Chem. Microbiol. Technol. Lebensm., vol. 6, 1979, pp. 25–30.

Survey of the Present Condition of Packaging Technology for Roasted Coffee with Special Consideration of Flavor Retention, by R. Radtke, 6th Int. Colloq. on Coffee., ASIC, Bogota, pp. 188–198, Jun. 4–9, 1973.

Vacuum Packing Retards Staling, by N. H. Coonen, Tea and Coffee Trade Journal, Jun. 1971.

Information About Oxygen Consumption of Roast Coffee and Its Influence on the Sensorially Evaluated Quality of Coffee, by R. Radtke in Chem. Mikrobiol. Technol. Lebensm., vol. 6 (#2), pp. 36–42.

Physical Considerations for the Packaging of Roasted Coffee in Flexible Packages, by K. Durichen & R. Heiss in Verpackungs-Rundschau 21, #5, Tech.-Wiss., Beil., 35–41 (1970).

PACKAGING OF FRESH ROASTED COFFEE EXHIBITING IMPROVED AROMA RETENTION

This is a continuation-in-part of application Ser. No. 216,554, filed on July 7, 1988.

TECHNICAL FIELD

The present invention has relation to method and packaging for preserving more of the aroma of fresh roasted coffee from the time the coffee is roasted until it has been fully utilized by the consumer.

The present invention has further relation to such packaging of coffee as soon as possible after roasting and, where desired, grinding, thereby minimizing its exposure to oxygen and preserving the majority of carbon dioxide and other gases remaining in the coffee after roasting in a substantially gas-impervious package. As used herein, a "substantially gas-impervious package" shall mean a package that exhibits a barrier which, prior to initial opening by the consumer, is sufficient to resist substantial penetration by oxygen over an extended period, e.g., between about 18 and about 24 months.

The present invention has further relation to such packaging of fresh roasted coffee in a semi-rigid, resealable, substantially gas-impervious container which substantially maintains its shape and structural integrity even under the pressures generated by the coffee off gassing over an extended period of time.

The present invention has further relation to such packaging which includes means for preventing aspiration of the roasted coffee from the package when the package is initially opened under pressure. This is particularly important when the coffee has been subjected to grinding after roasting.

The present invention has further relation to such packaging having a shape which permits easy dispensing of granular roasted coffee into a measuring cup. In a particularly preferred embodiment, the measuring cup serves as the primary pressure resistant, resealable closure. Predetermined measuring marks are preferably provided on the side wall of the measuring cup closure for correct product dosing in a single step.

The present invention has further relation to such packaging wherein the closure member provides not only an initial substantially gas tight seal until such time as the package of coffee is first opened by the consumer, but one which also exhibits an ability to establish 4 reseal which is effective to substantially resist ambient atmospheric pressure changes upon snug reapplication of the closure member to the package. Since a package of coffee is in most normal use cycles opened at least every one or two days after being placed in service, the normal period over which the reseal must resist ambient atmospheric pressure changes to minimize the ingress of atmospheric oxygen into the package is not more than about two days.

As used herein, a "substantially gas tight seal" shall be defined as one which will permit the gas evolved from the roasted coffee after initial application of the closure to the container to develop a noticeable internal pressure within the package prior to initial opening while the actual level of internal pressure developed in a package of roast coffee employing a substantially gas tight seal of the present invention will, of course, depend largely upon how much gas evolves from the coffee, the internally developed pressure is typically on the order of several pounds per square inch. In most instances these pressures are sufficient to aspirate coffee from the package upon opening unless suitable means are provided to vent the pressure before the package's discharge orifice is exposed.

Also as used herein, a reseal of the present invention which is "effective to substantially resist ambient atmospheric pressure changes" shall be defined as one which will produce an oxygen content in the package of roasted coffee which is at least about ten (10) percent lower than the oxygen content of the surrounding ambient atmosphere, as measured two days after the package has been initially opened, the closure member and filter removed for a period of about thirty seconds without removing any coffee from the package, and only the closure member thereafter snugly reapplied. For purposes of perspective, normal day-to-day atmospheric pressure changes in the U.S. are usually quite small. For example, *U.S. Weather Bureau Paper No.* 56 entitled '7 Interdiurnal Variables of Pressure and Temperature in the Coterminous U.S.38 lists the mean daily change for the central United States, which typically experiences the largest daily swings, to be only about 0.2 inches of Mercury for the winter and only about 0.1 inches of Mercury for the summer. Therefore it will be understood that although an effective reseal of the present invention will provide resistance to the entry of atmospheric oxygen into the package of roasted coffee, such an effective reseal is not necessarily gas tight, as that term is used in describing the seal which must be provided prior to initial opening of a package of the present invention by the consumer.

Finally, the present invention has relation to such packaging wherein the semi-rigid container is allowed to undergo limited, but predetermined deformation when subjected to the internal pressures generated by coffee off gassing prior to initial opening, said changes being confined to predetermined portions of the semi-rigid container to avoid instability of the container's base or jamming of the containers in their shipping cases due to excessive lateral growth.

BACKGROUND ART

It is well known in the art that fresh roasted coffee gives off substantial amounts of carbon dioxide and other gases, particularly after grinding. U.S. Pat. No. 1,992,556 issued to Tone on Feb. 26, 1935 teaches that roasted coffee, after it is ground, may be quickly sealed in containers in which the air has been replaced by an inert gas. Prior to sealing, the container is placed within a chamber and air is withdrawn from the chamber to create a vacuum on the chamber and the container. The vacuum is replaced by an inert gas which is delivered into the chamber under a pressure slightly above atmospheric pressure. The chamber is again placed under vacuum and the vacuum is again replaced by admitting an inert gas into the chamber. This cycle of operations may be continued until practically all of the air has been drawn out of the container and replaced by the inert gas. The cover closing the open end of the container is thereafter double seamed onto the container. According to the teachings of Tone, the gas contained within the roasted coffee will continue to evolve in the sealed container until the pressure of the container balances the pressure in the coffee cells, thereby preventing further evolution of gas from the roasted coffee. Tone states that when the coffee is opened, the coffee is practically in the same condition of freshly ground coffee, that is, the oils are free from rancidity and the coffee gas is housed within the cells of the coffee ready to evolve and pass off from the coffee in the same way that it does from the freshly ground coffee.

Tone does not disclose either the extent to which drawing vacuum prior to sealing of the container removes gases from the coffee or the gas pressure which is ultimately reached within the sealed container prior to opening. In addition Tone fails to disclose how the pressurized coffee is controlled when the container is initially opened or what happens to the coffee which is not immediately used upon initial opening of the container.

If coffee is packaged immediately after roasting and grinding without substantial off gassing, industry experience has demonstrated that the pressure of the carbon dioxide and other gases liberated from the coffee may cause serious bulging and even rupture of substantially gas-impervious bags, canisters or other containers used in the packaging.

According to the teachings of U.S. Pat. No. 2,430,663 issued to Behrman on Nov. 11, 1947, several methods have been used to overcome the difficulties caused by the development of pressure within substantially gas-impervious packages of roast and ground coffee. In connection with the use of glass jars and tin cans, Behrman teaches that vacuum packing has been practiced. In such packing it has been customary to use oversized containers to leave space for expansion. Even so, Behrman teaches that the pressure of the liberated carbon dioxide more than compensates for the vacuum packing with the result that when a can or jar of roast and ground coffee which has been packed prior to substantial off gassing is opened, a hissing noise is heard which is due, not to incoming air, but to escaping carbon dioxide.

Behrman further teaches that the problem encountered with flexible bags and other nonrigid containers of roast and ground coffee is that when a material is utilized which is sufficiently impermeable to prevent the ingress of atmospheric oxygen and the egress of gas evolved from the roast and ground coffee in the package, the containers are usually distorted and often ruptured by the pressure of the developing carbon dioxide.

One approach to solving this problem has been to employ mechanical gas escape valves intended to relieve the build up of pressure from within the flexible container while preventing the entry of atmospheric air into the package. Representative prior art escape valves for use on flexible packages are disclosed in: U.S. Pat. Nos. 3,595,467 issued to Goglio on July 27, 1971; 3,799,427 issued to Goglio on Mar. 26, 1974; and 4,420,015 issued to Blaser on Dec. 13, 1983. However, these valves, typically increase the cost of the flexible package utilized to house the roast and ground coffee. In addition, they do not always function in their intended manner.

Still another prior art approach to the packaging of roast and ground coffee, particularly in containers comprised of substantially gas-impervious material, involves subjecting the roast and ground coffee to a holding period sufficient to allow the coffee to substantially off gas and thereafter placing it into the container using a vacuum packing operation. This typically involves holding the coffee in vented bins for some period of time, which may range from a few hours for roast and ground coffee to a few days for whole roasted coffee beans, to allow the bulk of the carbon dioxide stored in the coffee during roasting to escape. In this regard, it is generally known that gases evolve from the coffee much more rapidly once it has been ground. Accordingly, if one desires to maximize the rate of off gassing prior to packing, the coffee is preferably subjected to grinding as soon as possible after roasting.

In the case of a rigid container, such as a metal can, vacuum packing of the coffee after it has been allowed to off gas at least to a degree, usually results in a residual vacuum still being present in the can upon opening. The degree of vacuum remaining in the metal can upon opening will, however, be generally lower than that present at the time of packing due to gases evolved from the coffee contained in the package after the package has been sealed. Therefore, the more off gassing which is allowed to take place prior to packing, the greater will be the degree of residual vacuum remaining in the metal can upon opening. Unfortunately, the more off gassing which is allowed to occur, the greater will be the degree of harmful oxidation of the coffee.

In the case of substantially gas-impervious flexible containers, vacuum packing of the coffee after it has been allowed to substantially off gas causes the walls of the flexible container to collapse against the coffee, thereby producing a hard or brick-like package until the hermetic seal is broken by the consumer opening the package. Because the bulk of the carbon dioxide exits the coffee before vacuum packing, the flexible package normally retains its brick-like appearance and feel until it is opened even though the residual vacuum pressure within the bag is less at the time of opening than at the time of packing due to gases evolved from the coffee after the package has been sealed. As will be appreciated, any appreciable positive pressure developed within the flexible container by gases evolved from the coffee may cause swelling or even bursting of the container. Accordingly, flexible containers subjected to vacuum packing generally require more off gassing of the coffee prior to packing to maintain a brick-like configuration until they are opened by the consumer.

While the vacuum packed brick-like bag approach has met with reasonable success in terms of minimizing the cost of packaging materials, it increases capital and production costs, since it does require a substantial number of holding bins to allow the roast coffee to off gas prior to packaging as well as additional labor to transport the roast coffee to and from the holding bins. Unfortunately, this process does expose the roast coffee to the atmosphere during the off gassing process. As a result, some of the desirable volatile aroma and flavor containing constituents of the fresh roasted coffee may be lost or their quality may be lowered by oxidation before the coffee product is packaged.

OBJECTS OF THE INVENTION

Accordingly, it is an object of the present invention to provide both method and packaging which will minimize oxidation of fresh roasted coffee and which will permit retention of many of the desirable volatile aroma and flavor containing constituents which are present in fresh roasted coffee from the time roasting is completed until the contents of the package have been substantially consumed by the end user.

It is another object of the present invention to provide both method and packaging which will permit the introduction of roast coffee in either whole bean or granular form into substantially gas-impervious containers without the need for a holding period to permit off gassing.

It is another object of the present invention to provide semi-rigid packaging for said fresh roast coffee which is capable of withstanding the pressure buildup caused by the release of carbon dioxide and other gases from the coffee by undergoing limited, but controlled deformation in predetermined portions of the package.

It is another object of the present invention to provide semi-rigid packaging for fresh roasted coffee which includes resealable closure means which are capable of establishing not only an initial substantially gas tight seal until such time as the package is first opened by the consumer, but also a reseal which is effective to substantially resist ambient atmospheric pressure changes, as these terms are defined earlier herein, after the container has been opened.

It is another object of the present invention to provide vent and/or filter means in said semi-rigid packaging to prevent aspiration of the pressurized roasted coffee, particularly when it is in granular form, from the discharge orifice of the container when the container is first opened by the consumer.

It is another object of the present invention, in a particularly preferred embodiment, to provide resealable closing means comprising a measuring cup which can be utilized to provide measured dispensing of discrete quantities of roasted and ground coffee from the package without the need for a measuring scoop or spoon, as is usually required.

It is another object of the present invention to provide semi-rigid packaging having a generally conical shape leading to the discharge orifice such that roasted and ground coffee will readily pour in a controlled manner from the dispensing orifice of the semi-rigid package without the need to totally invert and/or shake the package.

It is another object of the present invention to provide such semi-rigid packaging having a discharge orifice which is large enough to permit any unused roasted and ground coffee to be easily poured back into the package without spilling.

Finally, it an object of the present invention to provide such semi-rigid packaging having a resealable measuring cup closure which is either comprised of material which exhibits little or no static charge or which has been treated to minimize static so that granular coffee product does not cling to the interior of the closure member after the completion of a dispensing cycle.

DISCLOSURE OF THE INVENTION

The present invention comprises, in a particularly preferred embodiment, packaging for roasted and ground coffee which is to be packaged as quickly as is feasible after roasting, i.e., without undergoing substantial off gassing. The packaging preferably comprises a semi-rigid, substantially gas-impervious container capable of withstanding the pressures generated by the release of carbon dioxide and other gases from the fresh roasted coffee in the container. The semi-rigid container is preferably comprised of plastic and predetermined portions of the container are preferably capable of undergoing limited deformation. This prevents instability of the base of the container, thereby keeping its vertical axis erect, and ensures that the container does not become jammed within the shipping case in which it is transported due to lateral expansion.

The semi-rigid container includes resealable closure means which are capable of: (1) providing a substantially gas tight seal to the atmosphere prior to initial opening by the consumer; and (2) establishing a reseal which is effective to resist ambient atmospheric pressure changes, as these terms are defined earlier herein, after initial opening. The establishment of an effective reseal minimizes the ingress of atmospheric oxygen into the package of roasted coffee intermediate dispensing cycles after the package has been initially opened.

Means are preferably provided to prevent aspiration of the pressurized coffee, particularly when it is in granular form, from the discharge orifice of the container upon initial opening by the consumer. In a particularly preferred embodiment, the means for preventing aspiration comprises a porous filter member secured either across the discharge orifice of the container or to the resealable closure.

The means for securing the resealable closure onto the semi-rigid container preferably comprises complementary thread sets which include at least one gas vent to permit escape of the pressurized gas from the interior of the container before the threads become completely disengaged from one another. This prevents missiling of the resealable closure member in response to the pressure discharge upon initial opening.

The semi-rigid container preferably includes a conically shaped section leading to the discharge orifice to facilitate controlled pouring of the granular product without a requirement for completely inverting and/or shaking the container. The resealable closure means preferably comprises a measuring cup including predetermined graduation marks which are easily visible to facilitate dosing of predetermined quantities of the granular product without the need for a spoon or other measuring utensil. The discharge orifice of the semi-rigid container is preferably large enough in cross-section that any excess material remaining in the resealable closure can easily be poured back into the container without spilling.

The resealable closure means is preferably comprised of a material which exhibits little or no static charge or is treated with an antistat material so that it exhibits little or no tendency to retain any of the granular product on its interior surface after a dispensing cycle has been completed.

Unlike prior art vacuum packed metal coffee cans and vacuum packed brick-like bags, it has been observed that roasted coffee product housed in packaging of the present invention exhibits greatly improved aroma retention over the entire life of the package from initial opening by the consumer to emptying. While not wishing to be bound, it is believed that the improved aroma retention and product quality exhibited by packages of roasted and ground coffee of the present invention is due not only to reduced oxidation of the material both prior to and after packaging, but also to the retention of many of the volatile aromatic constituents within the coffee product due to the presence of the self-generated pressure within the container after the packaging operation has been completed.

Because packages of the present invention are not subject to residual vacuum when they are initially opened, there is no tendency to draw oxygen into the packages when they are initially opened by the consumer. This minimizes the tendency toward further oxidation of the coffee product. While not wishing to be bound, it is believed that establishing a reseal which is effective to substantially resist ambient atmospheric pressure changes, as these terms are defined earlier herein, allows a similar, but much lower, pressurization cycle to reoccur inside the package intermediate successive dispensing cycles. In this regard, it has been observed that when a reseal of the closure member to the container is effective to substantially resist ambient atmospheric pressure changes, as these terms are defined earlier herein, a noticeable aroma exudes from the container when the closure is removed. This further supports the consumer's perception of both enhanced aroma and improved freshness as the roast coffee is dispensed from a package of the present invention over a normal use cycle, e.g., about two to three weeks after initial opening. It is further believed that the resealed coffee package's tendency to slightly repressurize itself intermediate dispensing cycles helps to resist the ingress of atmospheric oxygen into the resealed package when the package is subjected to ambient atmospheric pressure changes between dispensing cycles.

Semi-rigid packages of the present invention may include either: (1) whole roasted coffee beans which are ground by the consumer at the point of purchase or prior to use; or (2) roasted coffee which has been ground and packaged by the coffee manufacturer as quickly as is feasible after roasting. Since off gassing occurs more slowly when the coffee is in whole bean form, maximum aroma and freshness benefits are retained for the consumer when the coffee is packaged in whole bean form as quickly as is feasible after roasting. Grinding of the whole beans by the consumer either at the point of purchase or prior to use causes a release of more of the desirable aroma and freshness volatiles from the whole roasted coffee beans at a time when they will be most noticed by the consumer.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE PRESENT INVENTION

Figure 1:
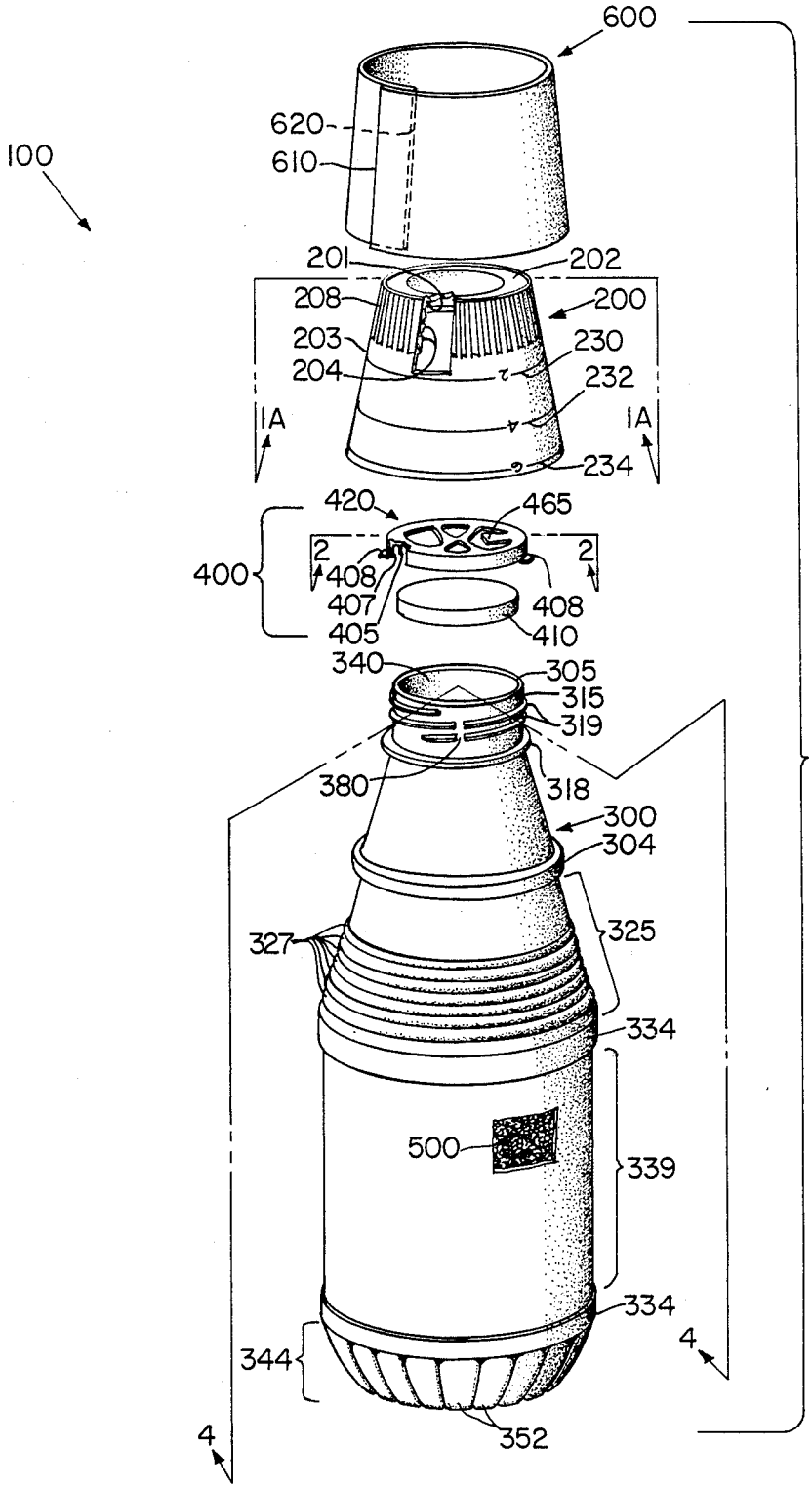
FIG. 1 is an exploded perspective view of a particularly preferred coffee package of the present invention.

FIG. 1 discloses a particularly preferred execution of a semi-rigid, substantially gas-impervious roasted and ground coffee package 100 of the present invention with the various components comprising the preferred package shown in an exploded relationship. In the illustrated embodiment the roasted and ground coffee package 100 comprises a semi-rigid container 300 preferably comprised of a moldable polymeric material, a resealable closure member 200 and a filter means 400 to prevent aspiration of the roasted and ground coffee product 500 from the container upon initial opening of the package by the consumer. A tamper evident shrink band 600 is preferably applied over the closure and shrunk in place to lock the closure to the finger support bead 304 on the container 300. The various components comprising the preferred package 100 will hereinafter be described in detail.

THE RESEALABLE MEASURING CUP CLOSURE 200

Figure 1A:
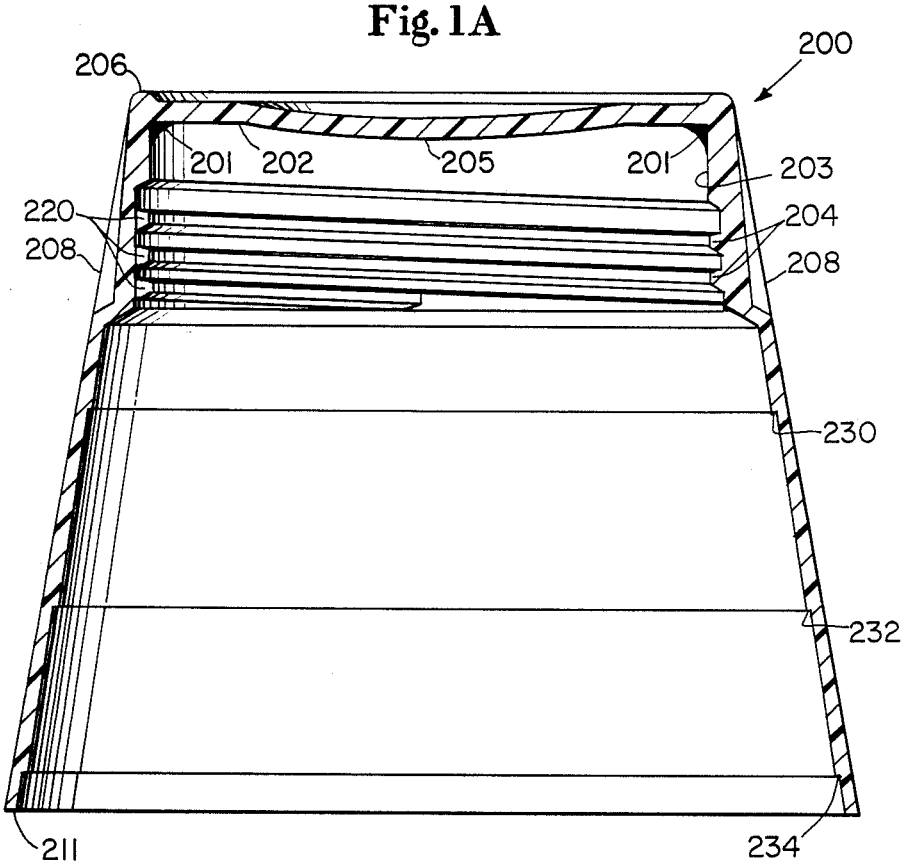
FIG. 1A is a simplified enlarged cross-sectional view of the resealable closure shown in FIG. 1 taken along section line 1A—1A of FIG. 1.

The resealable measuring cup closure 200 illustrated in FIG. 1 is shown in greatly enlarged simplified cross-section in FIG. 1A. The primary purpose of the closure 200 is to establish a substantially gas-tight pressure seal with the container 300, at least until such time as the package is initially opened by the consumer. This seal may be made with a hot melt binder compound 201 flowed into the inside perimeter of the closure 200 and adhered to the top panel 202 and/or the side wall 203 of the closure. Alternatively or additionally, the seal may include a separable element, such as the gas venting filter support 420 which may be formed of a resilient material and which may serve as a gasket between the innermost surface of the top panel 202 of the closure 200 and the uppermost surface or finish 305 of the container 300. The separable filter support 420 is thus trapped between the closure 200 and the finish 305 on the container 300 when the package 100 is assembled. If the gas venting filter assembly 400, including filter support 420, is discarded after the initial opening of the package 100, then the hot melt binder compound 201 may be used to ensure that the closure can be effectively resealed to the atmosphere against the finish 305 of the container 300. In this regard, it has been found that, for purposes of obtaining the benefits of the present invention, an effective reseal is one which substantially resists ambient atmospheric pressure changes, as these terms are defined earlier herein. Quantitatively, an effective reseal in accordance with the present invention is one wherein the oxygen content of the package is at least about ten (10) percent lower than the oxygen content of the surrounding atmosphere, as measured two days after the package has been initially opened, the closure member and filter removed for a period of thirty seconds without removing any coffee from the package, and only the closure member thereafter snugly reapplied.

For a package containing between about 15 and about 20 ounces of roast and ground coffee 500, the closure 200 typically contributes to safe and mess-free venting of about 0.1 to about 2.0 liters of carbon dioxide gas from the package headspace in less than one second when the package is first opened by a consumer. In the FIG. 1 embodiment, closure engagement with the container is maintained throughout gas venting before the closure is removed from the container. This is preferably accomplished by providing at least about 1.25 to about 2.0 turns of thread engagement between the container 300 and the closure 200. Vent channels 220 for rapid escape of the gas are preferably provided as vertical slots in the closure threads 204 and/or vertical slots 380 in the complementary threads 319 on the container 300.

The closure 200 is preferably designed to prevent or at least minimize doming of the top panel 202 above the heel 206 of the closure under internal package pressures up to about 20 psig. Prior to pressurization, the innermost portion 205 of the top panel 202 of the closure 200 is inwardly concave, as generally shown in FIGS. 1 and 1A. The thickness of the plastic material utilized in the top panel 202, which is typically between about 0.050 inches and about 0.080 inches, is chosen to provide sufficient stiffness to resist doming. If desired, vertical ribs 208 may be included on the outermost surface of the closure about its periphery to buttress the threads 204 against deformation caused by the torque of closure application and to reinforce the heel portion 206 of the closure 200.

The heel portion 206 located at the outer perimeter of the top panel 202 of the closure provides stability and helps to prevent tipping over when the closure is tested on its top panel, e.g., as on a countertop.

As can be seen in FIG. 1, measure marks 230, 232, 234 are preferably provided on the side of the closure 200 to relate the quantity of roasted and ground coffee in the measuring cup to a more conventional implement such as a spoon or a scoop. In the illustrated embodiment, the closure 200 is sized to permit dispensing of up to about six scoops of roast and ground coffee. This corresponds to the quantity normally utilized in preparing a conventional 12-cup pot of coffee. The closure 200 is preferably sized to allow a single dose of roast and ground coffee 500 to be poured from the container rather than requiring multiple fillings of the measuring cup, as would be the case if a conventional spoon or coffee scoop were utilized. The incremental markings can, of course, be placed especially for the particular coffee product composition housed in the package or the incremental markings can be placed to produce brews of either predetermined or varying strength. In the latter instances, the incremental marks may be positioned with respect to one another so that the volume of roasted coffee housed between adjacent sets of marks is not necessarily equal.

Experience has demonstrated that measuring errors are typically reduced utilizing this single fill approach when compared to a conventional spoon or coffee scoop using multiple fills. In addition, the closure 200 can easily be maintained in a sanitary condition and in close proximity to the package at all times, since it is required to provide an effective reseal of the package, as defined earlier herein, and thereby preserve the enhanced aroma and flavor benefits described herein.

In a particularly preferred embodiment the closure 200 is comprised of transparent or translucent polymeric material to allow more accurate measurement by viewing the product 500 through the closure side wall 203 as the measuring cup is being filled from the semi-rigid container 300. Clear or lightly pigmented polypropylene has been found to work well in this regard.

The polymeric composition and/or coating and the shape of the closure are selected so as to reduce mess after dumping of the predetermined quantity of roast and ground coffee into the coffee maker and reclosing the package. In this regard an antistatic formula is preferably incorporated into the closure resin to reduce the static charge of the closure from approximately plus or minus 2,000 volts to essentially 0 volts. Elimination of the static charge on the closure prevents static cling of the coffee particles to the closure after a dispensing cycle. In addition, the innermost surfaces of the closure and the thread profile are designed to minimize mechanical entrapment of coffee particles inside the closure after the roasted and ground coffee has been dumped into the coffee maker.

To minimize shelf height the closure 200 is also preferably designed to conform to and blend with the bottle finish without adding significant overall height to the package.

The outermost edges of side wall 203 of the closure are preferably flexible to aid pouring and to aid return of excess roasted and ground coffee into the semi-rigid container 300 through the container's discharge orifice 340 as well as to allow pouring of measured doses of roasted and ground coffee into small brewing baskets sometimes utilized on electric coffee makers. This flexibility is preferably sufficient to permit squeezing the outermost edges of the side wall 203 into an elliptical shape to produce a pouring spout at the closure's lip approximately 90° from the location where squeezing forces are applied to the side wall 203 of the closure. Closures comprised of polypropylene have been found to function extremely well without cracking or crazing, even at −10° F. This feature is particularly desirable in situations where the coffee is stored in the refrigerator freezer to maintain freshness.

If desired, the measuring marks 230, 232, 234 in the side wall 203 of the closure may be created by circumferential steps in thickness of the closure sidewall 203. This design not only provides a clear measuring mark around the entire perimeter of the closure, but in addition introduces circumferential ribs that help return the closure to a substantially circular cross-section after the side wall 203 has been squeezed and deformed for the purpose of controlling dumping of the roasted and ground coffee product from the closure.

As can be seen from FIGS. 1 and 1A, the outermost lip 211 of closure side wall 203 is preferably smooth to allow good control over dumping of the dose of resealable and ground coffee from the measuring cup into a receptacle.

ALTERNATIVE RESEALABLE MEASURING CUP CLOSURE 3200

Figure 3:
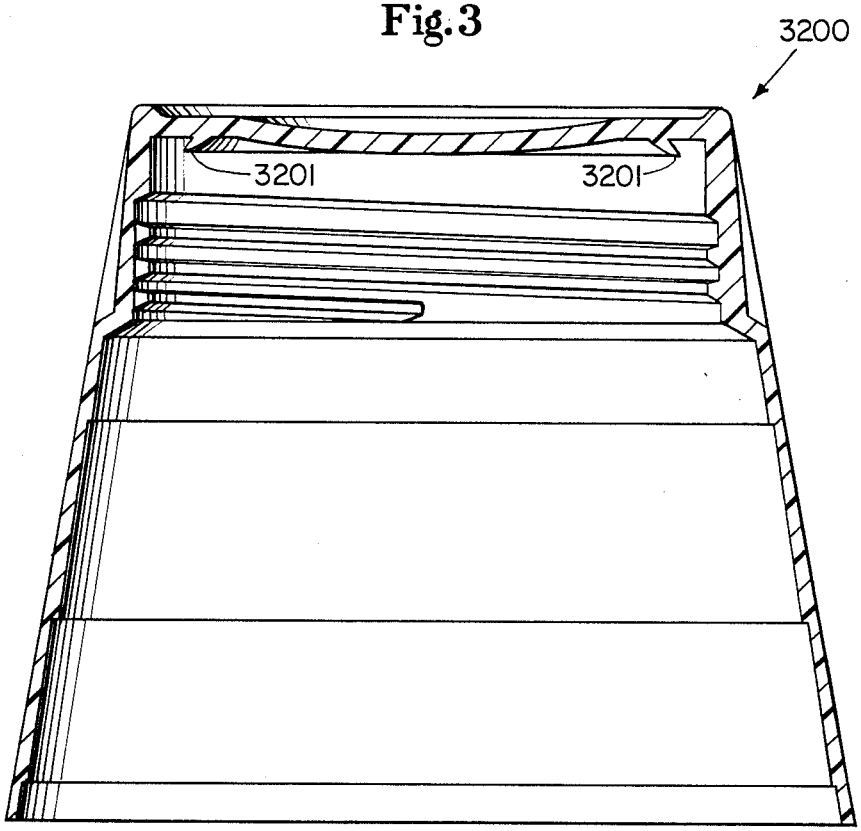
FIG. 3 is a simplified cross-sectional view of an alternative resealable closure which may be used in lieu of the resealable closure shown in FIG. 1.
Figure 4:
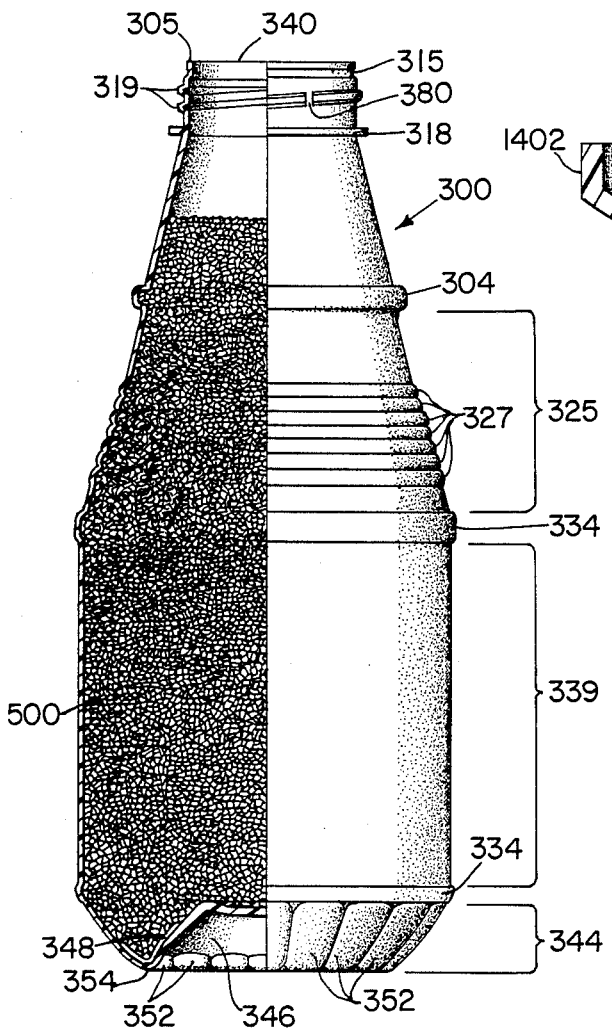
FIG. 4 is a simplified partial cross-sectional view of the semi-rigid container shown generally in FIG. 1, said view being taken along section line 4—4 of FIG. 1.

In FIG. 3 there is shown an alternative resealable measuring cup closure embodiment 3200 which is, with one exception, generally similar to resealable closure embodiment 200 shown in FIGS. 1 and 1A. However resealable closure embodiment 3200 does not employ hot melt binder compound 201 to establish a seal with container 300. Rather, resealable closure embodiment 3200 employs a V-shaped sealing member 3201 which is preferably resilient so that it can deform as required to establish a substantially gas tight initial seal with filter support 420 or a reseal which is effective to substantially resist ambient atmospheric pressure changes, as these terms are defined earlier herein, with the uppermost surface or finish 305 of container 300 when filter support 420 is not present.

THE OPTIONAL TAMPER EVIDENT SHRINK BAND 600

An optional tamper evident shrink band 600 normally comprised of PVC (polyvinyl chloride) is preferably applied over the heel 206 of the closure 200 and the finger support bead 304 on the container as generally shown in the exploded view of FIG. 1. Heat is used to shrink the cylindrical PVC band which locks onto the package.

The shrink band provides several functions that benefit consumers.

1. It provides visual evidence that the closure has not been removed from the package.
2. It protects the sanitary condition of the measuring cup closure prior to initial opening of the package.
3. It provides means to decorate and code the package to indicate product type. If desired, the shrink band could even extend below the finger support 304 onto the lower portions of container 300 and serve as a label or carry other advertising indicia of the coffee product 500 housed within the package 100. In the latter case a circumferential line of weakness (not shown) is preferably provided in the shrink band near finger support 304 to facilitate removal of that portion of the shrink band which secures closure 200 in place without removal of the label.
4. It can, if desired, be used as proof of purchase for sales promotion.

Two parallel vertical lines of weakness 610,620 introduced by perforation are preferably provided to create a tear strip that enables easy removal of the shrink band from its locked position on the package.

THE GAS VENTING FILTER ASSEMBLY 400

The gas venting filter assembly 400 shown in FIG. 1 prevents coffee spray during release of up to 20 psig gas pressure when the semi-rigid package 100 is opened for the first time. The filter must retain the coffee in the package while allowing the rapid escape of the carbon dioxide and other gases released into the confines of the package by the fresh roasted coffee 500.

1. The permeability of the filter 410 is preferably at least about 200 scfm at ½ inch of $H_2O$ pressure to pass 0.1–2.0 liters of gas in less than one second.
2. The filter 410 is typically comprised of woven or nonwoven material made using natural or synthetic fibers. Tensile strength of the filter must be sufficient to maintain structural integrity during gas venting and impact by coffee which is aspirated by the escaping gas.
3. When the coffee product 500 is in granular form, the pore size of the filter 410 is preferably fine enough to retain all particles coarser than about 5 microns in diameter, but should not be easily clogged by coffee particles or the filter can inhibit the rapid escape of gas needed for safe venting.

The filter assembly 400 must be secured across or over the container's discharge orifice 340 during venting of the gas from the package if it is to prevent unwanted discharge of coffee from the container 300.

The filter support 420, in a preferred embodiment, also acts as a gasket to aid in the formation of an initial substantially gas tight pressure seal between the closure 200 and the container's uppermost surface or finish 305.

The filter assembly 400 is preferably removable and disposable. It may, if desired, be printed with usage instructions or act as a proof-of-purchase.

After initial opening and pressure venting of the package 100, the filter assembly 400 may be discarded. Any subsequent pressure buildups which may occur within the package due to further off-gassing of the roasted coffee after the initial opening and establishment of an effective reseal of the closure with the container, as defined earlier herein, may be so low that they are not capable of being measured. Consequently, a gas venting filter to prevent coffee from spraying out of the package is not normally required on subsequent openings.

If desired, the package 100 may be provided with means for producing an audible signal, such as a "click", which signals the consumer when a reseal which will be effective to substantially resist ambient atmospheric pressure changes, as these terms are defined earlier herein, has been established between the container 300 and the closure 200. Since means for providing an audible signal between complementary parts are well known in the art, e.g., a ratchet mechanism, they have not been illustrated herein.

In the package embodiment 100 shown in FIG. 1, the filter element 410 comprises a flat disc which is held by a plastic filter support 420 which is removably mounted over the outside of the container finish 305. The filter 410 is held in the plastic filter support 420 by retention tabs 405 and/or a centrally located stake 406 which pierces the filter material. A pull tab 465 is preferably provided to permit easy removal of the filter assembly after the closure 200 has been removed from the container. This is best seen in the cross-section of FIG. 2.

Alternatively, a gas venting filter may be provided by microperforating a continuous top panel comprised of a unitary plastic or elastomeric material that generally resembles filter support member 420 and which removably mounts over the outside of the container finish 305.

Figure 2:
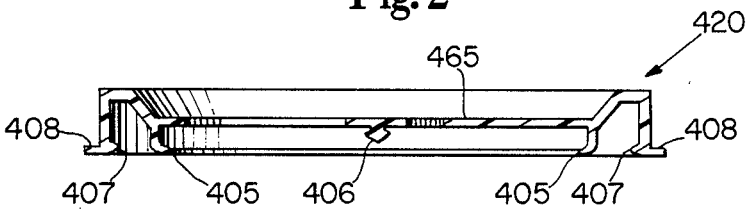
FIG. 2 is a greatly enlarged simplified cross-sectional view of the support used to maintain the gas venting filter shown in FIG. 1 in place across the discharge orifice of the container, said cross-sectional view being taken along section line 2—2 of FIG. 1.

In the embodiment illustrated in FIGS. 1 and 2 the filter assembly 400 is retained over the container's discharge orifice 340 by engagement of an internal snap bead 407 on the filter support 420 and a receiving ring 315 on the container finish 305.

The gas venting filter assembly 400 may be applied to the container 300 in a separate operation, or the assembly may be carried in the closure threads 204 or in a retention groove or on a retention bead by retention tabs 408 molded into the plastic filter support 420. Torquing the closure 200 onto the container 300 forces engagement of the snap bead 407 and receiving ring 315 on container 300 and transfers the gas venting filter assembly 400 from the closure 200 onto the container 300. The restraining force of the internal snap bead 407 on the filter support overrides the retention force of the tabs 408, and the filter assembly 400 remains in place on the container when the closure is unscrewed from the container by the consumer. In most instances it is manually removed and can be discarded by the consumer after the package has been initially opened. However, it can also, if desired, be reapplied to the container finish prior to reclosure of the package. In the latter instance the gasketing effect of the filter support 420 normally makes it much easier to establish a reseal which is effective to substantially resist ambient atmospheric pressure changes between dispensing cycles, as these terms are defined earlier herein.

ALTERNATIVE GAS VENTING FILTER ASSEMBLY 4400

Figure 8:
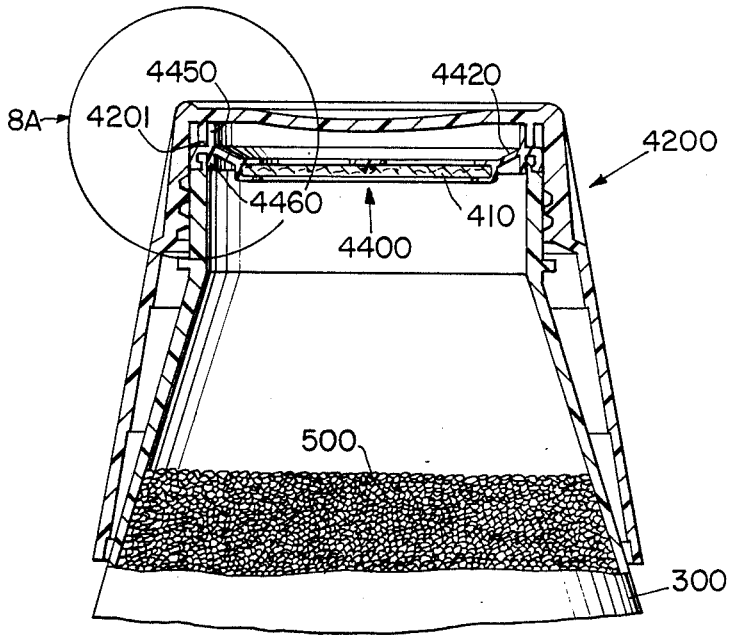
FIG. 8 is a simplified partial cross-sectional view of an alternate resealable closure and an alternate support used to maintain the gas venting filter shown in FIG. 1 in place across the discharge orifice of the semi-rigid container.
Figure 8A:
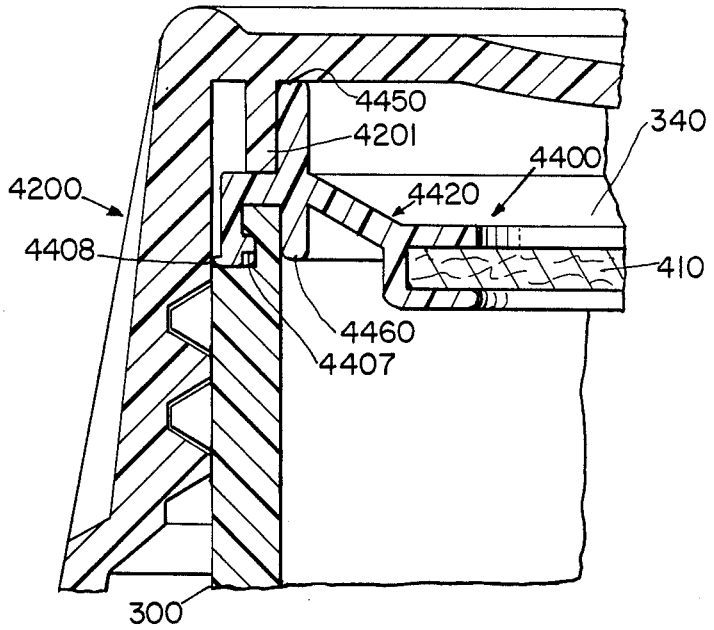
FIG. 8A is a greatly enlarged view of inset 8A shown in FIG. 8.

An alternative gas venting filter assembly 4400 which may be used in the practice of the present invention is shown in FIG. 8 and the greatly enlarged inset of FIG. 8A. The alternative gas venting filter 4400 shown in FIGS. 8 and 8A is used in conjunction with an alternative closure embodiment 4200 which differs from the embodiment 3200 of FIG. 3 in one principal respect. In particular, the V-shaped sealing member 3201 employed on closure embodiment 3200 is replaced with a tapered annular ring 4201, the innermost surface of which forms a seal with the upwardly projecting annular ring 4450 on filter support 4420 of filter assembly 4400. A similar downwardly projecting annular ring 4460 is provided on the lowermost surface of filter support 4420 as generally shown in FIG. 8A. The exterior surface of the lowermost annular ring 4460 provides a seal against the innermost surface of the semi-rigid container adjacent the container's discharge orifice 340.

In most other respects, filter assembly 4400 is identical to filter assembly 400 shown in FIG. 1. In particular, the filter 410 is identical to the filter employed in filter assembly 400. Furthermore, internal snap bead 4407 on the filter support 4420 may be identical to internal snap bead 407 on filter support 420. Finally, tab 4408 which temporarily secures the filter assembly to the closure 4200 during initial application may be identical to tab 408 on filter support 420.

ALTERNATIVE SELF-SUPPORTING FILTER 1400

Figure 5A:
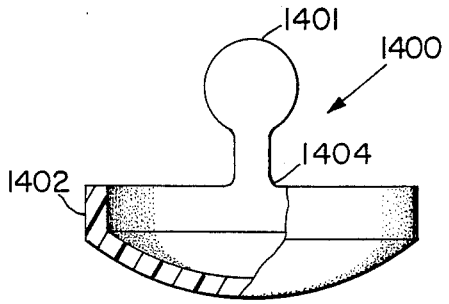
FIG. 5A is a simplified cross-sectional view of an alternative gas venting filter of the present invention with its gripping tab in an upright position.
Figure 5B:
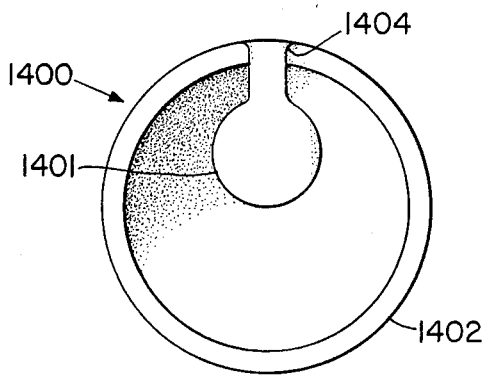
FIG. 5B is a plan view of the gas venting filter shown generally in FIG. 5A after the gripping tab has been folded into a horizontal position.

An alternative self supporting gas venting filter 1400 which may be employed in the practice of the present invention is shown in FIGS. 5A and 5B. A ledge (not shown) is preferably provided on the inside surface of the container 300 near the discharge orifice 340 of the container to prevent the filter from dropping inside. Friction is preferably employed to hold the filter in place.

The filter 1400 is shaped with a straight side wall 1402 to provide means for engaging the ledge inside the container near discharge orifice 340. The straight side wall 1402 of the formed filter 1400 also prevents the escape of coffee particles as the gas pressure forces the filter to rise in the container during pressure venting as the closure is unscrewed. The bottom of the filter 1400 exhibits an inwardly concave shape to resist pressure and maintain shape during the rapid escape of the gas vented from the package 100. The thickness and stiffness of the material comprising the filter 1400 are sufficient to maintain shape and rigidity so that the filter stays in place during distribution and shipping of the package. The formed self supporting filter 1400 may, if desired, be replaced by a disc of material of sufficient thickness and structural rigidity to provide all the necessary properties described hereinabove, e.g., a rigid foam. Thickness of the disc is preferably between about 0.050 and about 0.500 inches, depending upon the stiffness and porosity of the material employed.

A pull tab 1401 which is sufficiently large for easy grasping during removal is preferably provided on the filter 1400. The tab 1401 is folded parallel to the container opening when the filter is installed to prevent interference with proper gas tight sealing of the closure 200 and container 300. Width of the tab 1401 is preferably reduced at the juncture 1404 with the filter side wall 1402 to prevent a gap from forming at the point of contact with the container sidewall when the tab 1401 is folded parallel to the discharge orifice 340 of the container 300. This is particularly desirable, since any gap which might otherwise be formed is likely to allow escape of coffee particles from the container during gas venting.

The venting of gas through the self supporting filter 1400 normally will cause the filter to rise within the discharge passageway of the container 300. However, the filter is prevented from rising out of the container by the presence of the closure 200 which preferably remains engaged with the container until all pressure is vented. Side wall 1402 aids the filter in performing its function of retaining coffee in the package during pressure venting, even when the filter rises slightly in the container opening.

ALTERNATE MEANS OF PROVIDING GAS VENTING

Messiness from coffee spray can result if rapid and uncontrolled venting of gas is allowed to occur when the pressurized package 100 is first opened. Filter elements described hereinbefore represent a particularly preferred means for controlling this gas venting. Alternate means are described below for controlling gas venting without coffee spray.

Figure 6:
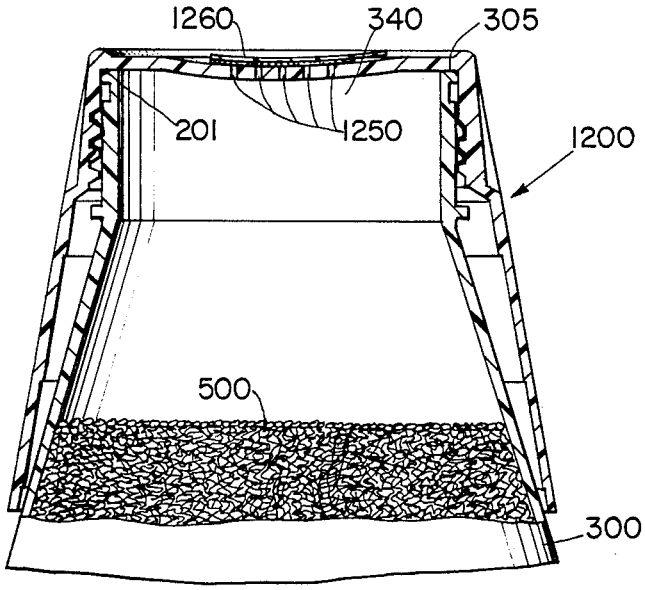
FIG. 6 is a simplified partial cross-sectional view of an alternative resealable closure of the present invention shown in an installed condition on a semi-rigid container of the type generally shown in FIG. 1.

FIG. 6 discloses the use of pinholes 1250 in a closure 1200, which is in other respects similar to closure 200, for gas venting either prior to or simultaneously with removal of the closure 1200. Pinhole size is preferably less than about 0.050 inches in diameter when the coffee 500 is in granular form so that gas venting can occur without the expulsion of coffee particles. A sufficient number of pinholes 1250 is preferably employed to permit venting of the gas before complete disengagement of the complementary threads on closure 1200 and container 300 to avoid the expulsion of coffee when the closure is removed. The pinholes may either be sealed with a membrane such as a pressure sensitive or heat sealed tape 1260 or sealed by a frangible portion of the cap (not shown). The tape is removed or the frangible member (not shown) broken to vent gas prior to complete unscrewing the measuring cup closure 1200. Ideally the tape is resealed or the frangible member is repositioned after the initial opening so as to permit establishment of a reseal which will be effective to substantially resist ambient atmospheric pressure changes intermediate dispensing cycles, as these terms are earlier defined herein.

Figure 7:
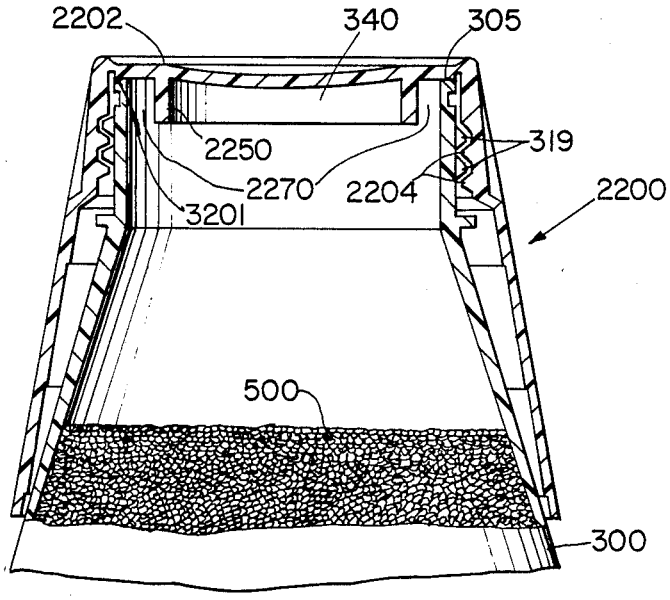
FIG. 7 is a simplified partial cross-sectional view of still another resealable closure of the present invention shown in an installed condition on a semi-rigid container of the type generally shown in FIG. 1.

FIG. 7 discloses still another means of venting pressure from within the package without complete removal of the closure 2200. In the FIG. 7 embodiment an annular ring 2250 projects from the top panel 2202 of the closure 2200, which is in other respects similar to closure 3200 shown in FIG. 3. The annular ring 2250 and the innermost surface of container 300 leading to discharge orifice 340 together form a tortuous path 2270 for venting gas while retaining coffee in the package when the seal between the innermost surface of top panel 2202 of closure 2200 and the container finish 305 is broken. This occurs before the threads 2204 on the closure have become completely disengaged from the complementary threads 319 on the container 300. To prevent the discharge of coffee, the distance between the inside of the container passageway and the outside of the annular ring 2250 is preferably between about 0.005 and about 0.050 inches when the coffee 500 is in granular form.

The thread clearance can be reduced and the number of thread turns engaging the container can be increased to continue the tortuous path 2270 and allow safe gas venting between the container threads 319 and the closure threads 2204. When no gas venting filter is employed, the number of thread turns engaging the semi-rigid container 300 and the closure 2200 is preferably at least about 2 and the thread clearance is preferably less than about 0.010 inches.

THE CONTAINER 300

One particularly preferred material for constructing a substantially gas-impervious semi-rigid container 300 of the present invention is oriented polyester. This material has sufficient barrier to oxygen, carbon dioxide and water vapor to protect the coffee product for periods ranging from about 18 to about 24 months during the distribution cycle. This material is also sufficiently damage resistant that it will not show damage from drops and impacts that are normal in distribution. The container 300 will not dent or break under normal shipping and handling conditions. Importantly, this material is capable of being formed commercially into a container that has the desired size and shape for proper handling and storage.

To ensure that semi-rigid containers of the present invention will not fail, it is preferred that the material and package design withstand up to about 20 psig internal pressure without gross deformation or instability in the base (roll out) that will prevent the bottle from standing upright on the shelf. Specifically preferred limitations are: maximum growth in height, about 0.200 inches; maximum volume expansion, about 2%; and maximum growth in diameter, about 0.070 inches.

The container 300 is preferably transparent or translucent to allow viewing of the product level for better pour control and to show the contents remaining during use. In a particularly preferred embodiment, the container 300 substantially screens damaging wavelengths of light shorter than about 400 nm. to protect the coffee 500 housed inside. One means of providing an effective screen involves tinting the container amber.

To make optimum use of the distribution pallet footprint and the available truck cube, the maximum diameter of the container is preferably between about 3.5 and about 6.5 inches. To comply with store shelf size limitations and to fit in storage locations that consumers normally reserve for coffee the maximum assembled height of package 100 is preferably less than about 10 inches.

As pointed out earlier herein, the container 300 preferably includes means to retain a gas venting filter across its discharge orifice 340 to allow venting of pressure without aspiration of coffee from the package. This may be a ledge inside its neck (not shown) to retain a self supporting filter insert 1400, as generally shown in FIGS. 5A and 5B, or a receiving ring 315 on the outside of the container's neck to retain the snap bead 407 of a filter support 420, as generally shown in FIG. 2. The uppermost surface of the container finish 305 preferably exhibits a smooth surface to permit formation of whatever type of seal is required, i.e., substantially gas tight or effective reseal, in cooperation with either the filter support 420 or the innermost surface of the top panel 202 of the closure 200, respectively.

The discharge orifice 340 of container 300 is preferably at least about 1.5 inches in diameter for smooth, even pouring and repouring of product using a measuring cup closure 200 having a side wall 203 which is deformable at its outermost edges. In general, the larger the diameter of the discharge orifice, the lesser will be the tendency for pressurized product to be aspirated from the container upon opening. However, as the discharge orifice becomes larger, it becomes harder to maintain control of pouring. In addition, the forces which must be resisted by the closure increase as the cross-sectional area of the closure increases.

The uppermost surface of container 300 preferably includes threads 319 to hold the closure 200 in place while the package is under pressure and to allow safe venting of gas before the closure is completely disengaged from the container. A high thread count (e.g., 8 threads/inch), low thread pitch is preferred to provide better retention of the closure under pressure. This thread design also improves the ease of opening for consumers. A modified buttress thread design is also preferred to improve thread engagement for pressure retention.

A minimum of at least 1.25 turns of thread engagement, but preferably at least 1.5–2.0 turns of thread engagement is provided in packages of the present invention to allow sufficient time for all pressure to be vented before the closure becomes completely disengaged from the container. The preferred thread engagement also allows convenient opening and reclosing of the package without excessive turning of the closure.

In a particularly preferred embodiment, the threads 319 on container 300 include a multiplicity of vertically oriented venting slots 380 to provide a path for gas to escape rapidly from the container once the seal between the innermost surface of top panel 202 of closure 200 and container finish 305 has been broken. This helps to assure elimination of gas before the closure threads 204 become disengaged from the container threads 319.

The support ring 318 required for the blow molding process to produce oriented PET containers 300 is sized with a minimum diameter to prevent interference with the measuring cup closure 200 which is designed to substantially conform to the shape of the bottle neck, as generally shown in FIG. 1.

A finger support bead 304 is preferably located at the top of the tapered grip area 325 to improve handling and prevent slipping of the container in the user's hand during pouring. Multiple beads 327 of constant cross-section, but steadily increasing diameter in the direction of the container's base, are preferably provided in the tapered grip area to interrupt the grip surface and provide improved handling during product pouring. The angle of taper in the neck and grip area of the container 300, which in a particularly preferred embodiment is around 15°, is preferably less than the angle of repose for roasted and ground coffee (40°–60°) to promote smooth pouring of the product from the bottle. Reentrant angles and ledges are eliminated to the greatest extent feasible to promote smooth pouring. Product should flow evenly and empty from the container completely without need for tapping the container when the vertical axis of the package is oriented approximately 60° from the horizontal position with its orifice 340 at the lowermost end.

Cross-sections taken perpendicular to the container's vertical axis along the entire length of the container 300 are preferably substantially circular. This enables the package 100 to hold pressure with minimum distortion.

Bumpers 334 are preferably provided to form a recessed label panel 339 and thereby protect the labels from container-to-container contact during packing and distribution. This prevents label damage due to scuffing.

The base 344 is designed with minimum height on the bottle side wall to maximize the size of the label panel 339. The inwardly concave base push-up 346 is preferably designed to prevent base roll out at package pressures up to about 20 psig.

In the illustrated embodiment a multiplicity of equally spaced ribs 348 are preferably molded internally in the base push-up 346 to assist in preventing base roll out under pressure. An equal number of equally spaced feet 352 are preferably provided in the area of the base 344 between the inwardly concave push-up 346 and the lowermost bumper 334. The feet 352 act as beam sections to further reinforce the base against roll out. In addition, these feet promote uniform deformation of the base perimeter when the bottle height grows vertically under pressure. Since plastic wall thickness at the base 344 is not normally completely uniform, the internal ribs 348 and the feet 352 tend to control base deformation and/or roll out which may otherwise tend to occur preferentially at the thinnest area of the base, thereby causing the container 300 to tilt.

In addition to the known technique of securing a discrete base cup to the bottom of a blown plastic container to impart stability, other known techniques for reinforcing the base on blown plastic containers are described in: U.S. Pat. Nos. 4,261,948 issued to Krishnakumar et al. on Apr. 14, 1981; 4,108,324 issued to Krishnakumar et al. on Aug. 22, 1978; and 3,871,541 issued to Adomaitis on Mar. 18, 1975, said patents being hereby incorporated herein by reference.

While the specific means employed to prevent base roll out is non-critical, it is important that the particular method selected prevent the vertical axis of the container from tilting substantially when the container is subjected to internal pressures of up to about 20 psig.

As will be appreciated, the largest possible diameter is desired at the heel 354 where the container 300 contacts a flat surface. The larger the heel diameter, the more stable will be the container 300 both on the packing line and in use by consumers. The illustrated base design eliminates the need to secure a separate base cup, such as is utilized on a number of soft drink containers, to impart stability to the bottom of containers of the present invention.

CONTAINER FILLING WITHOUT PERMITTING SUBSTANTIAL OFF GASSING

The semi-rigid container 300 and/or the freshly roasted and ground coffee 500 are preferably flushed with an inert gas, such as nitrogen or carbon dioxide, and the container is thereafter filled volumetrically and sealed on high speed packaging lines (e.g. 300–500 containers per minute). Alternatively, filled containers of the present invention can be injected with liquid nitrogen prior to sealing, also at high speed. By way of contrast, conventional prior art coffee packaging lines utilize relatively slow speed vacuum packing to fill metal cans or flexible bags at speed which are generally below about 300 containers per minute.

The semi-rigid plastic containers 300 of the present invention are quieter than metal cans or glass in the filling plant environment. Since they are also lighter than metal or glass packages of the same internal volume, weight reduction improves ease and economy of handling and shipping of finished cases.

Pressurized semi-rigid packages 100 of the present invention are also less prone to damage in the filling, warehousing, and distribution environments. Pressure is available in packages of the present invention from natural off gassing of the roasted coffee contained therein and/or by pressure augmentation with either liquid nitrogen or by packing and sealing the semi-rigid containers while they are subject to a pressurized nitrogen or carbon dioxide environment. Liquid nitrogen injection may be used to augment package pressure by 5–10 psig if desired. Pressure augmentation assures a rigid pack for good handling in warehouse stacks immediately after filling and case packing. Pressure augmentation also assures that consumes receive a pressure pack, even after the longest distribution/purchase cycle (e.g. 18–24 months).

As pointed out earlier in the present specification, the present invention can be practiced to advantage using either whole roasted coffee beans or roasted and ground coffee. Since most consumers do not have means for grinding the whole beans in their homes, the vast majority of coffee sold is in granular form. Whatever the form of the coffee utilized, the greatest benefits are obtained if the coffee is packaged as soon as is practical after roasting. Accordingly, where coffee is to be ground prior to packaging it is also desirable to initiate the grinding step as soon as is feasible after the roasting process has been completed.

Substantially immediate packing of coffee after grinding whole roasted beans eliminates the need for and the capital expense of degassing bins to hold coffee prior to packing. A degree of degassing is commonly practiced for roasted and ground coffee to be vacuum packed in metal cans, and an even greater degree of degassing is commonly practiced for roasted and ground coffee to be vacuum packed in flexible brick-like bags. The partial degassing helps to assure that at least some residual vacuum will remain in the package to prevent bulging and/or damage to the metal cans and flexible brick-like bags despite the fact that some further off gassing of the coffee will occur after the package has been sealed. The roasted coffee degassing period is normally in the range of about 1 to 12 hrs. after grinding for vacuum packed metal cans and about 2 to 12 hrs. after grinding for vacuum packed flexible brick-like bags. By way of contrast, semi-rigid coffee packages 100 of the present invention can be filled with roasted and ground coffee which has not been subjected to any hold time for degassing.

The quality of the coffee, as described hereinafter, is enhanced, at least to a degree, by packing it in a self-pressurizing package 100 of the present invention, even if the coffee is not packed immediately after roasting and grinding, i.e., some benefits are provided even if the roasted and ground coffee undergoes a normal hold time for degassing prior to packaging. Maximum benefits are, of course, achieved when little or no off gassing is permitted to occur prior to packing.

FACTORS CAUSING DEGRADATION OF COFFEE

From the collective prior art teachings of Prof. Dr. Dr. h. c. R. Heiss, et al. in an article entitled PACKAGING AND MARKETING OF ROASTED COFFEE in ASIC. 8e Colloque, Abidjan, 1977, pp. 163¼, November 28-December 3; O. G. Vitzthum and P. Werkhoff in an article entitled CHANGES OF THE AROMA OF ROAST COFFEE IN $O_2$-PERMEABLE BAG PACKS in *Chem. Mikrobiol. Technol. Lebensm., Vol.* 6; pp. 25–30 (1979); and R. Radtke in a paper entitled SURVEY OF THE PRESENT CONDITION OF PACKAGING TECHNOLOGY FOR ROASTED COFFEE WITH SPECIAL CONSIDERATION OF FLAVOR RETENTION in *6th INT. Colloq. on Coffee Sci., ASIC, Bogota*, pp. 188–98, June 4–9, 1973, all of which references are hereby incorporated herein by reference, it is believed that degradation of coffee quality normally occurs in three stages: (1) loss of aroma; (2) oxidation of flavor components; and (3) fat rancidity. These stages and their causes are discussed in greater detail in the following paragraphs.

(1) Loss of aroma.

Although in-container aroma is not necessarily related to the cup quality of coffee, the aroma is an attribute that is highly desirable to consumers. It is believed that aroma volatiles are often lost by holding roast coffee in bins exposed to the atmosphere prior to packing as well as by storage in a package that is either gas permeable or, if pot gas permeable, is not effectively resealed after opening.

(2) Oxidation of flavor components.

This is believed to be a result of oxygen exposure to the product. Potential sources of oxygen include exposure of coffee to air prior to packing (especially during degassing), insufficient elimination of oxygen from the package before sealing, transmission of oxygen through a gas permeable package and/or ingress of oxygen through an ineffective reseal when opened packages are reclosed.

Adsorption of oxygen (e.g., when product is held in degassing bins) occurs very rapidly. It is therefore expected that the freshness of coffee will be inherently better for product that experiences minimum exposure to air prior to packing because the initial oxygen load will be low.

(3) Fat rancidity.

This is believed to be caused by oxidation of coffee oils following extended exposure of the product to high oxygen levels. This effect is seldom seen by consumers.

BENEFITS OF THE PRESENT INVENTION

It is believed that one of the benefits achieved by practice of the present invention is reduced exposure of the roasted coffee product to oxygen not only prior to packing, but also throughout the storage and use cycle once the package is in the control of the consumer. Another benefit achieved by practice of the present invention is improved retention of volatile aroma. It is believed that packing coffee which has not been allowed to undergo substantial off gassing after roasting in a semi-rigid, substantially gas-impervious package which will resist internally generated pressures caused by off gassing until the package is initially opened by the consumer and which can establish a reseal which is effective to substantially resist ambient atmospheric pressure changes, as these terms are defined earlier herein, is primarily responsible for the aforementioned benefits.

To demonstrate this point, identically prepared coffee was packed in packages 100 of the present invention and in vacuum packed metal cans (27 in Hg vacuum). Coffee was roasted in traditional fashion. It was then held in whole bean form for about one day and then in ground form for about ½ hour prior to packing. After 12 weeks aging under ambient indoor storage conditions, packages of each type were opened and the aroma gas chromatograph counts were measured using the procedure hereinafter described in detail:

GAS CHROMATOGRAPH ANALYSIS TEST PROCEDURE

Equipment & Materials:

Sample packages to be tested.

Metal dial thermometer having a scale ranging from 40° F. to 160° F.

Carle Basic Gas Chromatograph, Model No. GC9700, as available from Hach Company of Loveland, Colo.

Hewlett Packard 3390A Integrator, as available from Hewlett Packard Company of Rolling Meadows, Ill.

1 cc Pressure-Lok brand syringe, as available from Dynatech Precision Sampling Corporation of Baton Rouge, La.

Standard Gas Mixture (0.5% Methane in Nitrogen), as available from Matheson Gas Products of Twinsburg (Dayton), Ohio.

Test Procedure:

(1) Draw a 0.25 cc sample of the Standard Gas Mixture into the syringe for calibration of Carle Basic Gas Chromatograph.

(2) Calibrate Chromatograph by injecting the 0.25 ml of Standard Gas Mixture into Chromatograph septum.

(3) Push "Start" on Integrator. Adjust the area reading to 65,000±1000 by adjusting the hydrogen flow into the Gas Chromatograph. Obtain two successive readings of 65,000±1000 before proceeding with start of actual test.

(4) To begin test, insert syringe needle through package with package oriented so needle tip is not immersed in the coffee. Draw a 0.25 ml sample of the package's internal uas. Obtain internal temperature of package by inserting metal dial thermometer through syringe hole for 3 minutes. Read temperature and record. Seal the resulting insertion hole with pressure sensitive foil barrier tape.

(5) Inject 0.25 cc sample of package's internal gas into septum of Chromatograph. Push "Start" on Integrator to obtain reading. Record GC count.

(6) Repeat entire procedure, including calibration of Gas Chromatograph, for each sample package to be tested. Sample packages should all be at a temperature of about 70° F.

The packages were then reclosed using resealable type closures 200 on containers 300 of the present invention and conventional plastic overcaps on the metal cans. All of the packages were stored under indoor ambient conditions throughout the period of testing. Product was then removed periodically from each group of packages over an 18 day period until the packages were empty. The oxygen analysis procedure used to evaluate the oxygen content of the packages is hereinafter described in detail:

OXYGEN ANALYSIS TEST PROCEDURE

Equipment & Materials:

Sample packages to be tested.

Mocon Toray Oxygen Analyzer Model LC700F, as available from Modern Controls Inc. of Minneapolis, Minn.

20 cc syringe with a Becton Dickinson 22GI.5 size needle, as available from Becton Dickinson of Rutherford, N.J.

Test Procedure:

(1) Draw a 10 cc sample of room air into the syringe for calibration of Mocon Analyzer.

(2) Calibrate Mocon Analyzer by injecting the 10 cc of room air into Mocon septum at a rate of 1 cc/second.

(3) Digital Readout should indicate 20.9±0.2 after calibration. If readout does not indicate this value, recalibrate. Once Mocon Analyzer is calibrated to 20.0±0.2, actual test can begin.

(4) to begin test, insert syringe needle through the package to be tested with package oriented so the needle tip is not immersed in the coffee. Draw a 10 cc sample of the package's internal gas. Seal the resulting insertion hole with pressure sensitive foil barrier tape.

(5) Inject 10 cc sample of package's internal gas into septum of Mocon Analyzer at a rate of 10 cc/second.

(6) Let digital readout stabilize for 15 seconds. Read percent oxygen from digital readout and record value.

(7) Repeat entire procedure, including calibration of Mocon Analyzer, for each sample package to be tested.

Table I below, wherein each piece of data represents the average of at least three replicates, indicates that the oxygen level in the headspace of the vacuum packed metal cans became substantially atmospheric on the second day after opening and remained at that level throughout the entire period of use. However, for packages 100 of the present invention, oxygen in the package was only about 12% on the second day after opening and did not increase to near atmospheric until much later in the use cycle.

Aroma, as measured by gas chromatograph counts, was essentially the same for both packages upon opening. However, aroma retention for the product in packages 100 of the present invention was substantially higher than for the plastic overcapped vacuum packed metal cans throughout the remainder of the product use cycle.

TABLE I

| | % oxygen (pkg headspace) | | Aroma Gas Chromatograph (in thousands) | |
|---|---|---|---|---|
| | pkg 100 | vac can | pkg 100 | vac can |
| 12 week unopened | .08 | 0.0 | 53.9 | 54.5 |
| 12 week unopened - 1 day after opening | | | 45.3 | 34.5 |
| 12 week unopened - 2 days after opening | 12.0 | 20.9 | 42.2 | 26.0 |
| 12 week unopened - 3 days after opening | 14.8 | 20.9 | 37.2 | 19.9 |
| 12 week unopened - 4 days after opening | 14.8 | 20+ | 37.0 | 17.4 |
| 12 week unopened - 7 days after opening | 16.1 | 20+ | 32.2 | 10.0 |
| 12 week unopened - 8 days after opening | 17.2 | 20+ | 30.8 | 8.6 |
| 12 week unopened - 9 days after opening | | | 28.2 | 8.9 |
| 12 week unopened - 10 days after opening | 18.1 | 20+ | 30.3 | 7.8 |
| 12 week unopened - 11 days after opening | 18.2 | 20+ | 28.1 | 6.1 |
| 12 week unopened - 14 days after opening | | | 27.9 | 4.6 |
| 12 week unopened - 15 days after opening | 18.8 | 20+ | 25.3 | 4.1 |
| 12 week unopened - 16 days after opening | | | 22.2 | 3.4 |
| 12 week unopened - 17 days after opening | 19.5 | 20+ | 22.4 | 2.5 |
| 12 week unopened - 18 days after opening | | | 20.6 | 2.0 |

The data in Table I clearly demonstrate the very real benefits relative to reduced oxidation and enhanced aroma retention which can be obtained by combining the steps of: (1) packaging roasted coffee without substantial off gassing in a semi-rigid, substantially gas-impervious package of the present invention and establishing a substantially gas tight seal when the closure is initially applied; and (2) establishing a reseal which is effective to substantially resist ambient atmospheric pressure changes, as these terms are defined earlier herein, after the package is initially opened. The following sections of the present specification will describe the respective contributions of each of the aforementioned steps.

COFFEE HOUSED IN PACKAGES CAPABLE OF WITHSTANDING THE PRESSURE GENERATED BY OFF GASSING RETAINS MORE VOLATILES IN THE PRODUCT

According to the aforementioned prior art teachings of Radtke, packing of coffee which has not been allowed to undergo substantial off gassing is preferred for superior coffee freshness. However, Radtke further teaches that the available packages and systems have made such packing impractical.

The semi-rigid, substantially gas-impervious package 100 of the present invention allows roasted coffee which has not been allowed to undergo substantial off gassing to be packaged without the risk of gross distortion or rupture common to prior art flexible packages. Such packing prior to substantial off gassing allows the coffee product to retain more gas and aroma volatiles than vacuum packing or packing in a flexible container employing a one-way venting valve.

For non-vented, substantially gas-impervious containers, loss of volatiles from the coffee can be indirectly determined by measuring the absolute change in package pressure from the time of packing to the time that equilibrium has been established. Conversely, flexible packages employing one-way vent valves do not preserve the coffee volatiles within the package, i.e., one-way vent valves allow gas and volatiles to escape into the atmosphere to prevent ballooning of the package. Therefore absolute changes in pressure within such packages are not an indirect measure of loss of volatiles.

The time required to establish equilibrium in a non-vented coffee package usually varies from about 1 to about 4 weeks, depending upon product grind, roast color, bean development, and product moisture. In this regard, it has generally been observed that the absolute change in pressure is generally smaller in packages of the present invention which are pressurized solely by product off gassing than for metal cans of comparable coffee which are initially packed under about 27 inches of Hg vacuum.

In general, vacuum packs allow gases evolved from the coffee to escape into the evacuated package headspace. If roasted and ground coffee which has not been subjected to substantial off gassing prior to packaging (i.e., roast and ground coffee such as that generally described in connection with the exemplary packages referred to in Table I) is initially packed in metal cans under about 27 inches of Hg. vacuum, most of these packages will be at approximately atmospheric pressure by the time equilibrium is established. This corresponds to an absolute pressure rise of about 27 inches of Hg. or about 13.3 psi. By way of comparison, packages 100 of the present invention when packed with identically processed roast and ground coffee at atmospheric pressure typically exhibit a positive pressure at equilibrium of about 8 psig., i.e., an absolute change in pressure of only about 8 psi. Therefore, the package 100 of the present invention reaches equilibrium with more volatiles retained in the product. Unlike the vacuum pack, these volatiles retained in the product are available for release from the product after the consumer opens the package.

THE INTERNALLY GENERATED PRESSURE PRESENT WITHIN COFFEE PACKAGES OF THE PRESENT INVENTION HELPS TO FORESTALL OXYGEN INGRESS UPON INITIAL OPENING

Initial opening of a pressurized package of the present invention allows gas to escape from the package to establish equilibrium with the atmospheric pressure surrounding the package. This process prevents the full atmospheric concentration of oxygen (approximately 20.9%) from entering the package immediately upon opening. By way of contrast, initial opening of most commercially available vacuum packed metal cans of coffee normally draws air (with approximately 20.9% oxygen) immediately into the package to vitiate the residual vacuum present within the metal can and establish pressure equilibrium with the atmosphere surrounding the package. Thus, the staling process is initiated immediately upon opening for most commercially available vacuum packed metal cans of coffee, but forestalled substantially for coffee packaged in accordance with the present invention by lower initial oxygen levels.

GAS EVOLVED IN COFFEE PACKAGES OF THE PRESENT INVENTION PRESERVES FRESHNESS BY HELPING TO MAINTAIN LOW OXYGEN LEVELS IN THE PACKAGE

So long as gas continues to evolve from roasted coffee housed in an effectively resealed package of the present invention, the oxygen content, as measured inside the package, is maintained at a level which is lower than the oxygen content of the surrounding ambient atmosphere.

The gas evolved from roasted coffee packed in accordance with the present invention also acts to enhance the aroma and freshness benefits described hereinbefore. After eight days normal usage, packages 100 of the present invention exhibited over three times more aroma (as measured by gas chromatograph counts) compared to a plastic overcapped metal can of initially identical roast and ground coffee product. The batch of coffee was roasted in traditional coffee roasters, held in whole bean form for about 24 hours, ground in conventional coffee grinders, and held in ground form for about 30 minutes. The batch was split, half being vacuum packed into metal cans and half being packed into packages 100 of the present invention. Packing for both legs occurred simultaneously. The evaluations were conducted at the same time for both legs. The evaluations began about 14 weeks after packing. Results are set forth in Table II below. Each data point represents the average of at least three replicates.

TABLE II

| Package | Measurable Pressure Using Conventional Pressure Gauge | Cumulative Number of Scoops Removed | Age (Days After Initial Opening | % Oxygen Inside Package | Gas Chromatograph Counts (In Thousands) |
|---|---|---|---|---|---|
| Plastic overcap/ metal can | 0 psig | 0 | 0 | 0.1 | 53.1 |
| | 0 | 3 | 0 | 17.9 | 53.1 |
| | 0 | 6 | 1 | 19.9 | 24.0 |
| | 0 | 9 | 4 | 20.9 | 14.3 |
| | 0 | 12 | 6 | 20.9 | 11.5 |
| | 0 | 15 | 8 | 20.9 | 8.8 |
| Threaded closure/ plastic container as generally disclosed in FIG. 1 | 8 psig | 0 | 0 | 0.1 | 57.8 |
| | 0 | 3 | 0 | 20.2 | 57.8 |
| | 0 | 6 | 1 | 13.6 | 31.6 |
| | 0 | 9 | 4 | 12.5 | 32.9 |
| | 0 | 12 | 6 | 16.4 | 27.6 |
| | 0 | 15 | 8 | 17.0 | 28.1 |

The above experiment was conducted to show that gas evolved from the coffee in package 100 actually reduces the oxygen content of the package. Before the first opening, both the metal can and package 100 had low oxygen levels (0.1%). At the first opening, the packages were treated as follows:

Package 100: The package was opened, the filter removed and discarded, and three scoops of coffee were removed. The package was then flushed with air and reclosed with its threaded closure to form an effective reseal, as defined earlier herein.

Metal can: The package was opened, and three scoops of coffee were removed. The can was then closed with its conventional plastic overcap.

Shortly thereafter, oxygen measurements were conducted on both packages. The can measured 17.9% and the package 100 measured 20.2%.

The next day, prior to opening the packages, oxygen measurements were taken. As expected the oxygen level in the metal can increased to 19.9%. Quite surprisingly, however, the oxygen level in package 100 of the present invention had substantially decreased since the previous day. Specifically, it had decreased from about 20.2% to about 13.6%.

Without wanting to be bound, it is believed that the decrease in oxygen content inside the effectively resealed packages 100 of the present invention was caused primarily by the evolution of gas from the roast and ground coffee contained within the packages 100, while the lack of an effective reseal in the plastic overcapped metal cans allowed the gases evolved from the roast and ground coffee contained within the package to readily escape from the packages and atmospheric oxygen to quickly enter the packages. It is therefore believed that packaging coffee which has not been allowed to undergo substantial off gassing in packages of the present invention delivers an additional freshness benefit not achievable with prior art metal cans using conventional plastic overcaps by exposing the coffee to less oxygen throughout the package's normal useful life.

THE PERMEABLE WALLS OF SEMI-RIGID PACKAGES OF THE PRESENT INVENTION RETAIN AROMA

The permeable walls of semi-rigid plastic packages of the present invention retain a high level of aroma gas chromatograph counts compared to the impermeable prior art metal cans. This can, if desired, be demonstrated by aroma measurement of the empty packages after dispensing coffee to simulate a normal usage rate until all of the coffee has been evacuated from the package. To compensate for their lack of retained aroma, impermeable prior art coffee packages, such as metal cans, have in fact been treated on their inside surfaces with aroma solvents to promote the retention of desirable aroma. This approach is generally disclosed in U.S. Pat. No. 4,034,116 issued on July 5, 1977.

While not wishing to be bound, it is believed that the permeable nature of the plastic container 300 of the present invention allows transmission and loss of certain of the low molecular weight volatiles associated with poor aroma character and/or coffee flavor while retaining certain of the desirable aroma volatiles.

ESTABLISHING AN EFFECTIVE RESEAL UPON RECLOSURE OF PACKAGES OF THE PRESENT INVENTION PRESERVES HIGHER COFFEE AROMA (GAS CHROMATOGRAPH COUNTS) EVEN WHEN THE COFFEE IS PACKAGED AFTER SUBSTANTIAL OFF GASSING

The ability of packages 100 of the present invention to establish a reseal which will effectively resist ambient atmospheric pressure changes, as defined earlier herein, after initial opening preserves coffee aroma better than the loose reclosure achieved by plastic overcapped metal cans. This effect has been observed for coffee that was first vacuum packed and allowed to establish complete pressure equilibrium in the vacuum packed can. The coffee in both legs of this experiment was initially identical four-month old current market product. The market cans were opened, and half was vacuum packed into metal cans while half was packed into semi-rigid, substantially gas-impervious packages 100 of the present invention after the packages had been flushed with inert gas. The repacking procedure was followed to minimize the chance of any substantial pressure being generated in any of the packages due to gases evolved from the coffee.

Two weeks following repacking, the packages were opened and aroma gas chromatograph counts were monitored during simulated normal use. As can be seen from Table IV, wherein each data point is the average of at least three replicates, after 13 days normal use, package 100 of the present invention with an effective reseal (threaded closure) retained approximately 70% of its initial aroma gas chromatograph counts, while the prior art metal can with loose reclosure (plastic overcap) retained only about 21% of its initial aroma gas chromatograph counts. It should also be noted that the initial aroma gas chromatograph counts in the repacked vacuum can are lower than for the repacked package 100 of the present invention due to the action of the vacuum packing, which tends to further remove aroma from the product.

TABLE IV

| Age (Days After Opening The Repacked Packages | Cumulative Scoops Removed | Aroma Gas Chromatograph Counts (In Thousands) Plastic Overcapped Metal Can | Package 100 With Resealed Closure |
|---|---|---|---|
| 0 | 3 | 29.0 | 37.3 |
| 2 | 12 | 19.9 | 30.4 |
| 5 | 15 | 13.1 | 28.5 |
| 7 | 21 | 10.8 | 26.5 |
| 13 | 24 | 6.0 | 26.0 |

While particular embodiments of the present invention have been illustrated and described, it will be obvious to those skilled in the art that various changes and modifications can be made without departing from the spirit and scope of the invention, and it is intended to cover in the appended claims all such modifications that are within the scope of this invention.

What is claimed is:

1. A semi-rigid, resealable, substantially gas-impervious package of roasted coffee exhibiting enhanced aroma not only upon initial opening, but throughout its useful life, said package comprising:

(a) a semi-rigid container comprised of substantially gas-impervious polymeric material and including a discharge orifice, said semi-rigid container exhibiting a predetermined shape when both its interior and exterior surfaces are exposed to the atmosphere;

(b) a predetermined quantity of coffee deposited within said semi-rigid container after roasting but before substantial off gassing has been allowed to occur, said roasted coffee containing a substantial quantity of its natural carbon dioxide and other gases at the time it is introduced into said container;

(c) a closure establishing a substantially gas tight seal to the atmosphere across said discharge orifice in said semi-rigid container when said closure is initially applied to said semi-rigid container after filling thereof with said coffee, whereby any gases emitted from said roasted coffee are prevented from escaping from said package, thereby pressurizing the interior of said package relative to the atmosphere and causing predetermined portions of said semi-rigid container to undergo limited deformation without rupturing and without appreciably altering said predetermined shape of said container prior to initial opening thereof by the end user, said closure further including means for establishing a reseal across said discharge orifice of said semi-rigid container after initial opening thereof by the end user, said reseal being effective to substantially resist ambient atmospheric pressure changes and thereby retain enhanced coffee aroma within said package throughout its useful life;

(d) means for preventing said coffee from being aspirated through said discharge orifice of said container when said closure is initially removed from said container; and (e) vent means which can be placed in fluid communication with the interior of said container to relieve the internal pressure generated from the release of said gases from said coffee before said closure is completely removed from said container.

2. The package of claim 1, wherein said roasted coffee is in granular form.

3. The package of claim 1 or claim 2 wherein said closure is sealingly secured across the discharge orifice of said semi-rigid container by means of complementary screw threads on said closure and said container.

4. The package of claim 3, wherein said means for preventing said coffee from being aspirated through the discharge orifice of said container when said closure is initially removed therefrom and said vent means comprise a tortuous passageway formed between said closure and said container, said passageway being sufficiently small that said coffee cannot pass therethrough, said passageway having sufficient cross-sectional area, as measured perpendicular to its length, to permit complete relief of the pressure inside said container before said complementary threads on said closure and said container become completely disengaged from one another.

5. The package of claim 3, wherein said means for preventing said coffee from being aspirated through the discharge orifice of said container when said closure is initially removed therefrom comprises a porous filter secured across said discharge orifice of said container and wherein said vent means comprises a passageway located exteriorly of said filter and formed between said closure and said container, said passageway having sufficient cross-sectional area, as measured perpendicular to its length, to permit complete relief of the pressure inside said container before said complementary threads on said closure and said container become completely disengaged from one another.

6. The package of claim 3, wherein said means for preventing said coffee from being aspirated through the discharge orifice of said container when said closure is initially removed therefrom and said vent means comprise a multiplicity of discrete holes which are small enough to prevent said coffee from passing therethrough, said discrete holes being integrally formed in said closure, said closure further including reusable means for sealing said multiplicity of discrete holes to the atmosphere.

7. The package of claim 5, wherein said porous filter is secured in place across said discharge orifice of said container by said closure.

8. The package of claim 7, wherein said porous filter is self-supporting.

9. The package of claim 1 wherein said semi-rigid container comprised of substantially gas-impervious polymeric material exhibits a substantially cylindrical cross-section, as measured at any point along its vertical axis.

10. The package of claim 9, wherein said container includes a conically shaped section joining its discharge orifice to the remainder of said container, said conically shaped section exhibiting an angle of taper relative to the vertical axis of said container which will permit easy pouring of said coffee from said container without need for completely inverting or tapping on said container.

11. The package of claim 10, wherein said coffee is in granular form and wherein said angle of taper of said conical portion of said container is less than the angle of repose of said granular coffee.

12. The package of claim 11, wherein said angle of taper of said conical section of said container is about 15°.

13. The package of claim 9 or claim 10, wherein said container includes a base portion which is reinforced relative to the remainder of said container to substantially prevent non-uniform deformation of said base and tilting of said container's vertical axis when said container is subjected to internal pressures of up to about 20 psig.

14. The package of claim 13, wherein said base portion has an upwardly concave central portion including a multiplicity of internal, radially oriented ribs.

15. The package of claim 13, wherein said base portion has an upwardly concave central portion, said upwardly concave central portion of said base being surrounded by multiplicity of outwardly convex, radially oriented feet located adjacent one another and connecting said upwardly concave central portion of said base to the remainder of said container.

16. The package of claim 13, wherein said base portion has an upwardly concave central portion including a multiplicity of internal, radially oriented ribs, said upwardly concave central portion of said base being surrounded by a multiplicity of outwardly convex, radially oriented feet located adjacent one another and connecting said upwardly concave central portion of said base to the remainder of said container.

17. The package of claim 16, wherein said container further includes at least one portion of substantially constant cross-section as measured along the vertical axis of said container, the lowermost end of said substantially constant cross-section portion being secured to the outermost ends of said radially oriented feet of said base portion about the periphery of said base.

18. The package of claim 1, wherein said closure comprises a measuring cup for dispensing said coffee into an appliance.

19. The package of claim 18, wherein said closure includes a multiplicity of graduated measuring marks to aid in dispensing predetermined quantities of coffee.

20. The package of claim 16, wherein said closure exhibits essentially zero static charge to prevent said coffee from adhering thereto after completion of a dispensing cycle.

21. The package of claim 19, wherein said closure includes a side wall having a resiliently deformable skirt which can be caused to form a pouring spout by applying manual squeezing forces to opposed surfaces thereof.

22. The package of claim 21, wherein said graduated measuring marks are integrally molded in said closure and extend about the entire periphery of said resiliently deformable skirt, said molded measuring marks also serving as reinforcing ribs to restore said resiliently deformable skirt to its undeformed condition when said manual squeezing forces are removed therefrom.

23. The package of claim 21, wherein said discharge orifice on said container is circular and exhibits a diameter which is large enough to permit refilling coffee from said closure into said container substantially without spillage.

24. The package of claim 23, wherein the diameter of said discharge orifice in said container is at least about 1.5 inches.

25. A semi-rigid, resealable, substantially gas-impervious package of roasted and ground coffee exhibiting enhanced aroma not only upon initial opening, but throughout its useful life, said package comprising:

(a) a semi-rigid container comprised of substantially gas-impervious polymeric material and including a discharge orifice, said semi-rigid container exhibiting a predetermined shape when both its interior and exterior surfaces are exposed to the atmosphere;

(b) a predetermined quantity of roasted and ground coffee deposited within said semi-rigid container after roasting but before substantial off gassing has been allowed to occur, said roasted and ground coffee containing a substantial quantity of its natural carbon dioxide and other gases at the time it is introduced into said container;

(c) a closure establishing a substantially gas tight seal to the atmosphere across said discharge orifice in said semi-rigid container when said closure is initially applied to said semi-rigid container after filling thereof with said coffee, whereby any gases emitted from said roasted and ground coffee are prevented from escaping from said package, thereby pressurizing the interior of said package relative to the atmosphere and causing predetermined portions of said semi-rigid container to undergo limited deformation without rupturing and without appreciably altering said predetermined shape of said container prior to initial opening thereof by the end user, said closure further including means for establishing a reseal across said discharge orifice of said semi-rigid container after initial opening thereof by the end user, said reseal being effective to substantially resist ambient atmospheric pressure changes and thereby retain enhanced coffee aroma within said package throughout its useful life;

(d) means for preventing said coffee from being aspirated through said discharge orifice of said container when said closure is initially removed from said container, said means for preventing aspiration comprising a porous filter secured across the discharge orifice of said container; and (e) vent means which can be placed in fluid communication with the interior of said container to relieve the internal pressure generated from the release of said gases from said coffee before said closure is completely removed from said container, said vent means comprising a tortuous passageway between said closure and said container, said passageway being located exteriorly of said porous filter.

26. An improved method of preserving the aroma of fresh roasted coffee in a package of said coffee at least until the package contents have been consumed by the end user, said method comprising the steps of:

(a) depositing said fresh roasted coffee into a substantially gas-impervious container through its discharge orifice without allowing substantial off gassing of said coffee, thereby preserving a substantial quantity of the natural carbon dioxide and other gases within said coffee;

(b) applying a resealable closure across the discharge orifice of said container to form a substantially gas tight seal to the atmosphere until the package is opened by the consumer, whereby any gases emitted from said roasted coffee are prevented from escaping from said package, thereby pressurizing the interior of said package relative to the atmosphere;

(c) releasing the pressure from the inside of said container prior to completely removing said closure from said container to avoid aspirating said coffee through the discharge orifice of said container;

(d) removing said closure from said container and dispensing coffee through the discharge orifice of said container;

(e) reapplying said closure to said container so as to form a reseal which is effective to substantially resist ambient atmospheric pressure changes; and (f) repeating steps (c) through (e) until substantially all of said coffee has been dispensed from said container, whereby the loss of carbon dioxide and other gases and the attendant aromatic volatiles from said coffee is slowed throughout the useful life of said package, thereby retaining more of the coffee aroma initially present in the fresh roasted coffee throughout the useful life of said package.

27. The method of claim 26, including the step of grinding said coffee after roasting and before depositing it into said substantially gas-impervious container.

28. The method of claim 27, including the step of inert gas flushing said freshly roasted and ground coffee and said container prior to depositing said coffee in said container.

29. The method of claim 27, including the step of inert gas flushing said container prior to depositing said coffee in said container.

30. The method of claim 27, wherein said container of coffee is subject to pressurized inert gas when said closure is initially sealingly applied to said container.

31. The method of claim 29, wherein said inert gas is selected from the group consisting of nitrogen and carbon dioxide.

32. The method of claim 27, including the step of injecting liquid nitrogen into the coffee in said container prior to initially sealingly securing said closure thereto, thereby further augmenting the internal pressure generated within said container after it has been sealed to the atmosphere.

33. The package of claim 1 or claim 25, wherein said initial gas tight seal to the atmosphere and said reseal across said discharge orifice of said container are both formed directly between said closure and the discharge orifice in said container.

34. The package of claim 7 or claim 25, wherein said porous filter includes a support member having opposite surfaces, one of which contacts said closure and the other of which contacts said discharge orifice of said container when said closure is applied to said container, whereby said initial gas tight seal to the atmosphere is formed between said closure, said support member and said discharge orifice of said container.

35. The package of claim 34, wherein said reseal is formed directly between said closure and said discharge orifice in said container in the event said filter and support are discarded after initial opening of said package.

* * * * *